US009351062B2

(12) United States Patent
Inoda et al.

(10) Patent No.: US 9,351,062 B2
(45) Date of Patent: May 24, 2016

(54) MICROPHONE UNIT

(75) Inventors: Takeshi Inoda, Osaka (JP); Ryusuke Horibe, Osaka (JP); Fuminori Tanaka, Osaka (JP); Shuji Umeda, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 344 days.

(21) Appl. No.: 13/813,812

(22) PCT Filed: Jul. 14, 2011

(86) PCT No.: PCT/JP2011/066058

§ 371 (c)(1),
(2), (4) Date: Feb. 1, 2013

(87) PCT Pub. No.: WO2012/017795

PCT Pub. Date: Feb. 9, 2012

(65) Prior Publication Data

US 2013/0129133 A1 May 23, 2013

(30) Foreign Application Priority Data

Aug. 2, 2010 (JP) ..... 2010-173289

(51) Int. Cl.
*H04R 1/08* (2006.01)
*H04R 19/04* (2006.01)
*H04R 19/00* (2006.01)

(52) U.S. Cl.
CPC ..... *H04R 1/08* (2013.01); *H04R 19/04* (2013.01); *H04R 19/005* (2013.01)

(58) Field of Classification Search
CPC ..... H04R 1/08
USPC ..... 381/337, 346
See application file for complete search history.

(56) References Cited

U.S. PATENT DOCUMENTS 5,745,588 A * 4/1998 Bartlett ..... H04R 1/2869 381/170
2006/0116180 A1* 6/2006 Minervini ..... 455/575.1

(Continued)

FOREIGN PATENT DOCUMENTS

JP 2005295278 10/2005
JP 2007150507 6/2007

(Continued)

OTHER PUBLICATIONS

International Search Report mailed Aug. 16, 2011 for PCT Application No. PCT/JP2011/066058, filed Jul. 14, 2011.

*Primary Examiner* — Duc Nguyen
*Assistant Examiner* — Phan Le
(74) *Attorney, Agent, or Firm* — Amster, Rothstein & Ebenstein, LLP

(57) ABSTRACT

A microphone unit (1) is provided with an electro-acoustic transducer (13) which converts acoustic signals into electric signals on the basis of the oscillation of a diaphragm (134), and a housing (10) which contains the electro-acoustic transducer (13). The housing (10) is provided with: a first sound conduction space (SP1) that guides sound waves from the outside to one side of the diaphragm (134) via at least one first aperture (18) formed on the exterior of the housing (10); and a second sound conduction space (SP2) that guides sound waves from the outside to the other side of the diaphragm (134) via at least one second aperture (19) formed on the exterior of the housing (10). The total square area of at least one first aperture (18) and the total square area of at least one second aperture (19) are not the same.

15 Claims, 9 Drawing Sheets

(56) References Cited

U.S. PATENT DOCUMENTS

| | | | | |
|---|---|---|---|---|
| 2010/0142743 | A1* | 6/2010 | Tanaka et al. | 381/346 |
| 2011/0158450 | A1 | 6/2011 | Tanaka et al. | |
| 2011/0176698 | A1 | 7/2011 | Tanaka et al. | |
| 2011/0195745 | A1 | 8/2011 | Inoda et al. | |
| 2011/0261987 | A1 | 10/2011 | Nakanishi et al. | |

FOREIGN PATENT DOCUMENTS

| | | |
|---|---|---|
| JP | 2009188943 | 8/2009 |
| JP | 2010136132 | 6/2010 |
| WO | 2009034786 | 3/2009 |
| WO | 2010013602 | 2/2010 |
| WO | 2010013603 | 2/2010 |

* cited by examiner

MICROPHONE UNIT

CROSS-REFERENCE TO RELATED APPLICATIONS

This application is a U.S. national stage entry under 35 U.S.C. §371 of PCT International Application No. PCT/JP2011/066058, filed on Jul. 14, 2011, and claims priority to Japanese Application No. JP 2010-173289, filed on Aug. 2, 2010, the contents of which are incorporated herein by reference in their entirety.

TECHNICAL FIELD

The present invention relates to a microphone unit that converts an input sound into an electric signal and outputs the electric signal.

BACKGROUND ART

Conventionally, a microphone unit, which has a function to convert an input sound into an electric signal and output it, is applied to: voice communication apparatuses such as a mobile phone, a transceiver and the like; information process systems such as a voice identification system and the like that use a technology for analyzing an input voice; or recording apparatuses and the like, and various microphone units are developed (e.g., see patent documents 1 to 3).

Among conventional microphone units, as disclosed in the patent documents 1 and 2, for example, there are microphone units of type that vibrate a diaphragm by means of a difference between sound pressures acting on both surfaces of the diaphragm to convert a sound signal into an electric signal. Hereinafter, this type of microphone unit is sometimes expressed as a differential microphone unit.

A differential microphone unit is able to demonstrate an excellent distant noise alleviation performance in a case where it is used as a close-talking mike. Because of this, in usage of a mobile phone apparatus and the like which require the function of a close-talking mike, a differential microphone unit is useful.

CITATION LIST

Patent Literature

PLT1: JP-A-2009-188943
PLT2: JP-A-2005-295278
PLT3: JP-A-2007-150507

SUMMARY OF INVENTION

Technical Problem

In the meantime, a differential microphone unit is provided with: a first sound guide space that guides a sound wave from outside to one surface (first surface) of a diaphragm; and a second sound guide space that guides a sound wave from the outside to the other surface (rear surface of the first surface) of the diaphragm. In recent years, there is a tendency that an apparatus incorporating a microphone unit is reduced in size and thickness, and also requests for size reduction and thickness reduction of a microphone unit are strong. Because of this, as a structure of a differential microphone unit, for example, it is preferable that as disclosed in the patent documents 1 and 2, the same outer surface of a housing that composes the microphone unit is provided with: an opening for connecting the first sound guide space and the outside to each other; and an opening for connecting the second sound guide space and the outside to each other. According to this structure, it becomes possible to achieve the size and thickness reductions of a microphone unit, and it is possible to simplify a structure of a sound guide space (which is not the sound guide space of the microphone unit) disposed in an apparatus which incorporates a microphone unit.

However, according to this structure of a differential microphone unit, it becomes hard to make the shapes of the first sound guide space and the second sound guide space identical to each other. And, in a case where the same shape is not obtained, it becomes hard to match frequency characteristics of both with each other. The applicant of the present application has knowledge that if the frequency characteristic when a sound wave travels in the first sound guide space is different from the frequency characteristic when a sound wave travels in the second sound guide space, it is impossible to obtain a good distant noise alleviation performance in a wide frequency band. In other words, a differential microphone unit aimed at the above size reduction raises a problem that it is impossible to obtain a good distant noise alleviation performance in a wide frequency band, and it becomes crucial to solve the problem.

It is conceived that an acoustic resistor member found in the microphone unit of the patent document 2 is disposed in the first sound guide space and/or the second sound guide space; whereby the frequency characteristics are adjusted to solve the problem. However, according to the structure which uses the acoustic resistor member (e.g., felt or the like is used), in a case where for example, a MEMS (Micro Electro Mechanical System) chip is used as an electro-acoustic conversion device that converts a sound signal into an electric signal based on vibration of the diaphragm, a problem rises, in which because of dust occurring from the acoustic resistor member, the electro-acoustic conversion device easily malfunctions.

Here, a microphone package (microphone unit) disclosed in the patent document 3 has a structure in which the same surface of the housing is provided with two openings, which however is not a differential microphone unit. Of the two openings, one is a leak hole that is disposed to improve a sound reception characteristic for a sound signal. In this microphone package, it is not necessary to match the frequency characteristic of a space that opposes one surface of the diaphragm with the frequency characteristic of a space that opposes the other surface of the diaphragm, accordingly, the above problem does not occur.

In light of the above points, it is an object of the present invention to provide a high-quality microphone unit that is able to obtain a good distant noise alleviation performance in a wide frequency band and able to be reduced in size.

Solution to Problem

To achieve the above object, a microphone unit according to the present invention includes: an electro-acoustic conversion device that converts a sound signal into an electric signal based on vibration of a diaphragm; and a housing that houses the electro-acoustic conversion device; wherein the housing is provided with: a first sound guide space that guides a sound wave from outside to one surface of the diaphragm via at least one first opening that is formed through an outer surface of the housing; and a second sound guide space that guides a sound wave from the outside to the other surface of the diaphragm via at least one second opening that is formed through the outer surface of the housing; and a total area of the at least one first opening and a total area of the at least one second opening are different from each other.

The microphone unit having the above structure is able to exert a sound pressure onto one surface of the diaphragm by means of the first sound guide space and a sound pressure onto the other surface of the diaphragm by means of the second sound guide space, and functions as a differential microphone unit. And, the first opening and the second opening, which respectively input sounds from the outside into the two sound guide spaces, are disposed such that the total areas are different from each other, accordingly, it is possible to approximate a frequency characteristic (resonance frequency) when the sound wave travels in the first sound guide space to a frequency characteristic (resonance frequency) when the sound wave travels in the second sound guide space. As a result of this, according to the present structure, it is possible to obtain the microphone unit that shows a good distant noise alleviation performance in a wide frequency band. Here, the present structure approximates the frequency characteristics to each other when the sound wave travels in the two sound guide spaces by devising the structure of the housing. Because of this, "malfunction of the electro-acoustic conversion device due to occurrence of dust," which is concerned in a case of approximating the frequency characteristics to each other by means of the acoustic resistor member when the sound wave travels in the two sound guide spaces, is unlikely to occur.

In the microphone unit having the above structure, it is preferable that the second sound guide space has a shape different from that of the first sound guide space; and the first opening and the second opening are formed through the same outer surface of the housing. In a case where the shapes of the two sound guide spaces are different from each other as shown in this structure, the distant noise alleviation performance of the differential microphone unit easily declines thanks to a difference between the frequency characteristics of the two sound guide spaces. However, thanks to devising the structures of the first opening and the second opening, the microphone unit, which shows the good distant noise alleviation performance in the wide frequency band, is obtained. Besides, in the present structure, the first opening and the second opening are disposed through the same outer surface of the housing, which is accordingly advantageous to size reduction and thickness reduction.

In the microphone unit having the above structure, the electro-acoustic conversion device may be disposed in the first sound guide space, and the total area of the first opening may be larger than the total area of the second opening. There is a tendency that usually the sound guide space in which the electro-acoustic conversion device is disposed is larger in volume than the sound guide space in which the electro-acoustic conversion device is not disposed and the resonance frequency becomes low. In this point, according to the present structure, the total area of the first opening that connects to the larger-volume sound guide space is formed larger than the other, whereby it is possible to approximate the frequency characteristics to each other when the sound wave travels in the two sound guide spaces.

In the microphone unit having the above structure, there may be one first opening formed and there may be a plurality of the second openings formed, besides, there may be one first opening formed and there may be one second opening formed.

In the microphone unit having the above structure, the housing may include a mount portion on which the electro-acoustic conversion device is mounted, and a cover that is disposed over the mount portion to cover the electro-acoustic conversion device; the mount portion may be provided with a first mount portion opening that is covered by the electro-acoustic conversion device mounted on the mount portion, a second mount portion opening that is formed through a same surface as the first mount portion opening, and an intra-mount portion space that connects the first mount portion opening and the second mount portion opening to each other; the cover may be provided with a housing space that houses the electro-acoustic conversion device mounted on the mount portion, at least one first through-hole whose one end connects to the housing space and whose other end connects to the outside, and at least one second through-hole which does not connect to the housing space, whose one end connects to the second mount portion opening, and whose other end connects to the outside; the first opening may be given by the first through-hole, and the second opening may be given by the second through-hole; the first sound guide space may be formed by means of the first through-hole and the housing space; and the second sound guide space may be formed by means of the second through-hole, the first mount portion opening, the second mount portion opening, and the intra-mount portion space. According to the present structure, it is possible to simplify the structure of the differential microphone unit that is able to be reduced in size and thickness, and the production becomes easy.

In the microphone unit having the above structure, an electric circuit portion, which processes the electric signal obtained from the electro-acoustic conversion device, may be disposed in the first sound guide space. For example, it is possible to dispose the electric circuit portion outside the housing, but the present structure more facilitates handling of the microphone unit.

Advantageous Effects of Invention

According to the present invention, it is possible to provide a high-quality microphone unit that is able to obtain a good distant noise alleviation performance in a wide frequency band and able to be reduced in size.

DESCRIPTION OF EMBODIMENTS

Hereinafter, embodiments of a microphone unit to which the present invention is applied are described in detail with reference to the drawings. However, for the sake of easy understanding of the present invention, a structure of a microphone unit (hereinafter, called an earlier developed microphone unit) developed earlier by the applicant of the present application and its problem are described in advance.

(Earlier Developed Microphone Unit)

Figure 9A:
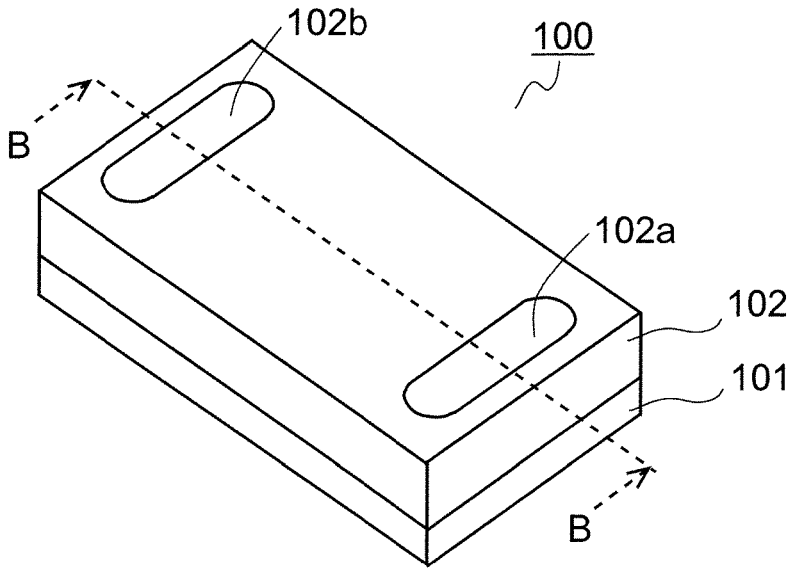
FIG. 9A is a schematic perspective view showing an appearance structure of an earlier developed microphone unit.
Figure 9B:
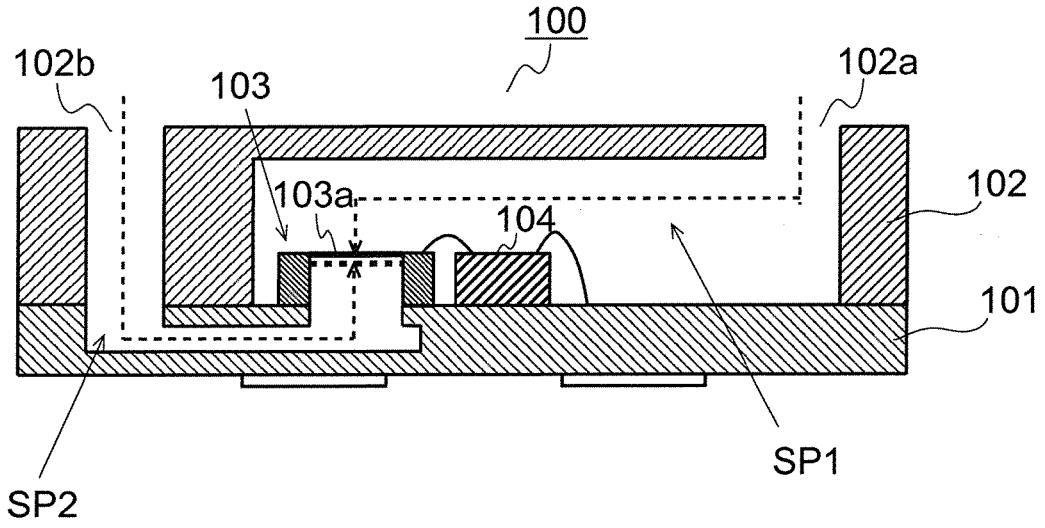
FIG. 9B is a sectional view taken along a B-B position of FIG. 9A.

FIG. 9A and FIG. 9B are views showing a structure of an earlier developed microphone unit, of which FIG. 9A is a schematic perspective view showing an appearance structure, and FIG. 9B is a sectional view taken along a B-B position of FIG. 9A. As shown in FIG. 9A and FIG. 9B, an earlier developed microphone unit 100 has a structure in which a MEMS (Micro Electro Mechanical System) chip 103 and an ASIC (Application Specific Integrated Circuit) 104 are housed in a housing that has a substantially rectangular parallelepiped shape formed of a mount portion 101 and a cover 102.

The MEMS chip 103 has a diaphragm 103*a*, and functions as an electro-acoustic conversion device that based on vibration of the diaphragm 103*a*, converts a sound signal into an electric signal. Besides, the AISC 104 amplifies the electric signal output from the MEMS chip 103. An upper surface of the cover 102 that composes the housing of the microphone unit 100 is provide with two openings 102*a* and 102*b* that have the same shape (substantially rectangular shape or substantially stadium shape) and area. The first opening 102*a* is disposed close to one end portion in a long-edge direction of the microphone unit 100, while the second opening 102*b* is disposed close to the other end portion in the long-edge direction of the microphone unit 100, and both are ranged symmetrically with respect to a center of the microphone unit 100.

The housing composed of the mount portion 101 and the cover 102 is provided inside with: a first sound guide space SP1 that guides a sound wave from outside to an upper surface of the diaphragm 103*a* of the MEMS chip 103 via the first opening 102*a*; and a second sound guide space SP2 that guides the sound wave from the outside to a lower surface of the diaphragm 103*a* of the MEMS chip 103 via the second opening 102*b*. In other words, the microphone unit 100 is composed as a differential microphone unit.

Here, the MEMS chip 103 and the ASIC chip 104 are disposed in the first sound guide space SP1. The MEMS chip 103 is disposed in the first sound guide space SP1, whereby the first sound guide space SP1 and the second sound guide space SP2 are partitioned from each other. Besides, in the microphone unit 100, the first sound guide space SP1 and the second sound guide space SP2 are disposed such that a sound travel distance when the outside sound travels from the first opening 102*a* to the upper surface of the diaphragm 103*a* and a sound travel distance when the outside sound travels from the second opening 102*b* to the lower surface of the diaphragm 103*a* become substantially equal to each other, whereby a sound travel time span when the outside sound travels from the first opening 102*a* to the upper surface of the diaphragm 103*a* and a sound travel time span when the outside sound travels from the second opening 102*b* to the lower surface of the diaphragm 103*a* become equal to each other.

Figure 10:
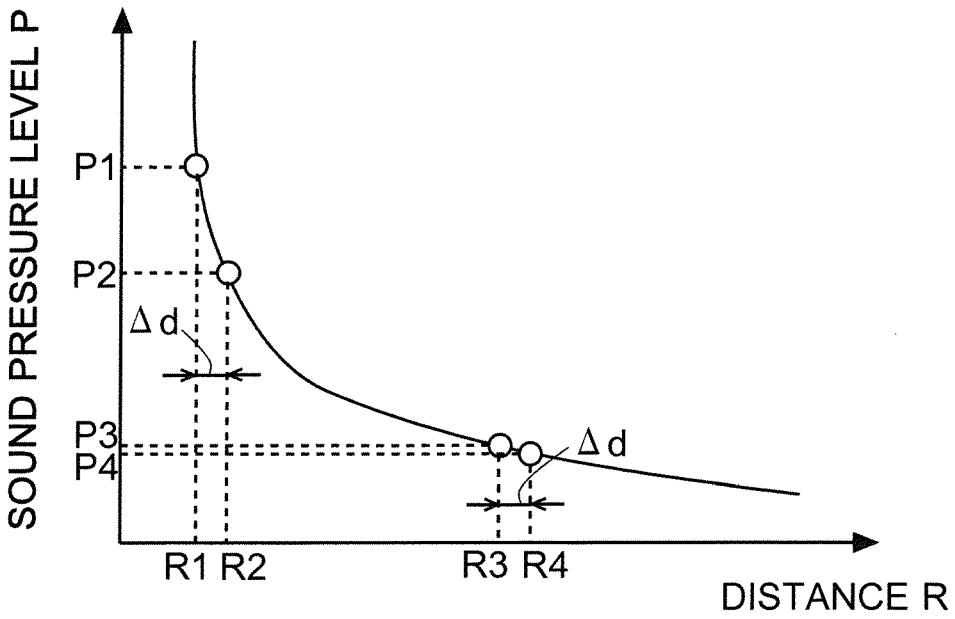
FIG. 10 is a graph showing a relationship between a sound pressure P and a distance R from a sound source.

Characteristics of the earlier developed microphone unit 100 having this structure are described. Before description, properties of a sound wave are described. FIG. 10 is a graph showing a relationship between a sound pressure P and a distance R from a sound source. As shown in FIG. 10, a sound wave attenuates as it travels in a medium such as air and the like, and a sound pressure (strength and amplitude of the sound wave) declines. The sound pressure is in inverse proportion to the distance from the sound source, and the relationship between the sound pressure P and the distance R is expressible as the following formula (1). Here, k in the formula (1) is a proportionality constant.

$$P=k/R \tag{1}$$

As is clear from FIG. 10 and the formula (1), the sound pressure steeply attenuates (left side of the graph) at positions near the sound source, and attenuates (right side of the graph) more slowly as it goes away from the sound source. In other words, the sound pressure transmitted to two positions (R1 and R2, or R3 and R4) away from each other by Δd in distance from the sound source dramatically attenuates (P1−P2) from R1 to R2 where the distance from the sound source is small, while the sound pressure does not dramatically attenuate (P3−P4) from R3 and R4 where the distance from the sound source is large.

Figure 11:
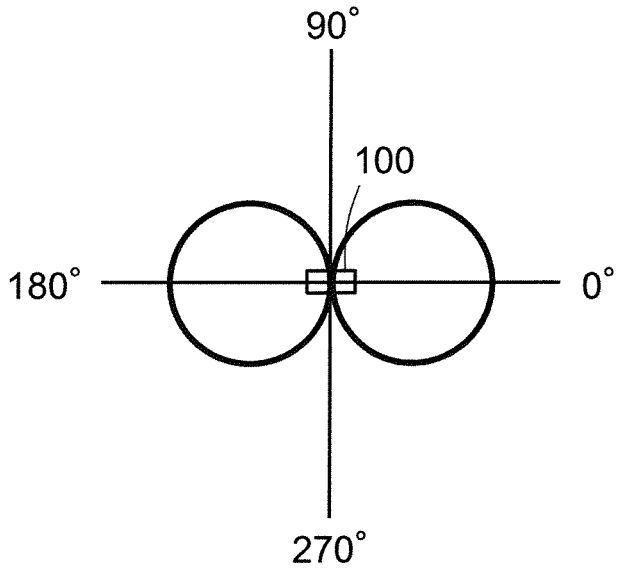
FIG. 11 is a view showing a directional characteristic of an earlier developed microphone unit.

FIG. 11 is a view showing a directional characteristic of the earlier developed microphone unit. In FIG. 11, an attitude of the microphone unit 100 is the same as the attitude shown in FIG. 9B. If the distance between the sound source and the microphone unit 100 is constant, when the sound source is present in a direction of 0° or 180° in FIG. 11, the sound pressure acting onto the diaphragm 103*a* becomes maximum. This is because the difference between the distance when the sound wave released from the sound source travels to the upper surface of the diaphragm 103*a* via the first opening 102*a* and the distance when the sound wave released from the sound source travels to the lower surface of the diaphragm 103*a* via the second opening 102*b* becomes maximum. Besides, when the sound source is present in a direction of 90° or 270° in FIG. 11, the sound pressure acting onto the diaphragm 103*a* becomes minimum (substantially 0). This is because the difference between the distance when the sound wave released from the sound source travels to the upper surface of the diaphragm 103*a* via the first opening 102*a* and the distance when the sound wave released from the sound source travels to the lower surface of the diaphragm 103*a* via the second opening 102*b* becomes substantially 0.

In other words, as shown in FIG. 11, the microphone unit 100 functions as a bidirectional microphone unit that has a high sensitivity to the sound waves which are input from the directions of 0° and 180°, and a low sensitivity to the sound waves which are input from the directions of 90° and 270°.

Here, envisioning a case where the microphone unit 100 is used as a close-talking mike, characteristics of the microphone unit 100 are described.

The sound pressure of a target sound released from near the microphone unit 100 dramatically attenuates between the first opening 102*a* and the second opening 102*b*. Because of this, a large difference occurs between the sound pressure transmitted to the upper surface of the diaphragm 103*a* and the sound pressure transmitted to the lower surface of the diaphragm 103*a*. On the other hand, background noise has its sound source at a distant position compared with the target sound, and the sound pressure hardly attenuates between the first opening 102*a* and the second opening 102*b*. Because of this, the sound pressure difference becomes very small between the sound pressure transmitted to the to the upper surface of the diaphragm 103*a* and the sound pressure transmitted to the lower surface of the diaphragm 103*a*.

The sound pressure difference of the background noise received by the diaphragm 103*a* is very small, accordingly, the sound pressures of the background noise are substantially cancelled out at the diaphragm 103*a*. In contrast to this, the sound pressure difference of the target sound received by the diaphragm 103*a* is very large, accordingly, the sound pressures of the target sound are not cancelled out at the diaphragm 103*a*. Because of this, a signal produced by the vibration of the diaphragm 103*a* can be regarded as a signal of the target sound from which the background noise is removed. In other words, the microphone unit 100, when used as a close-talking mike, demonstrates an excellent distant noise alleviation performance.

However, the applicant of the present application has a knowledge that the earlier developed microphone unit 100 has problems as follows. Hereinafter, the problems are described.

Figure 12:
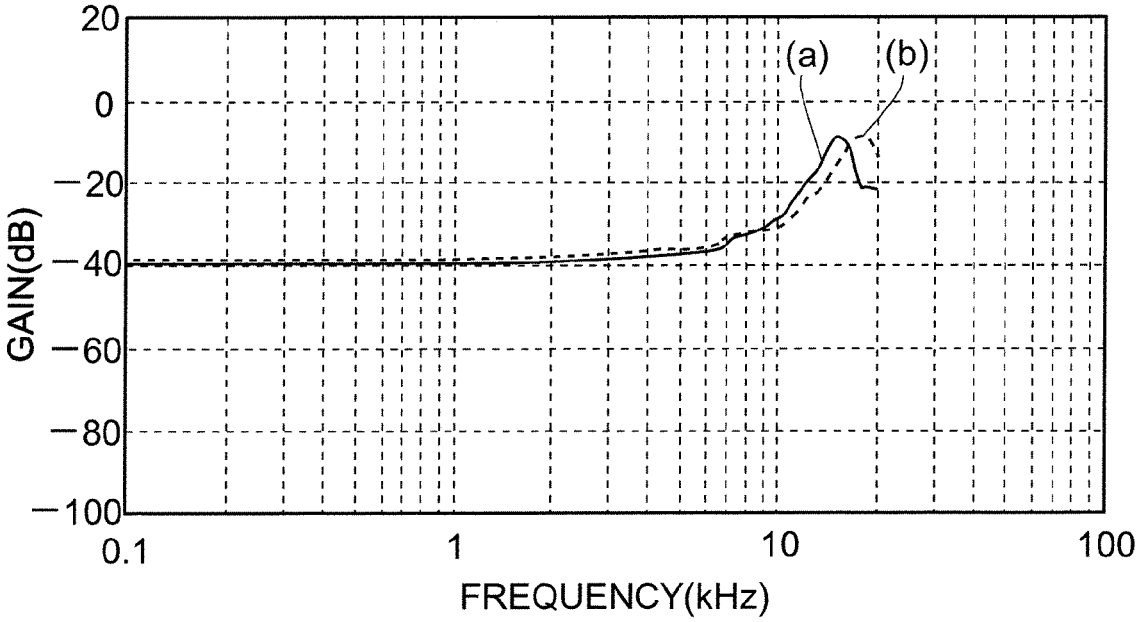
FIG. 12 is a graph showing a frequency characteristic in a case where either one only of a first sound guide space and a second sound guide space is used in an earlier developed microphone unit.

FIG. 12 is a graph showing a frequency characteristic in a case where either one only of the first sound guide space and the second sound guide space is used in the earlier developed microphone unit. In FIG. 12, a horizontal axis (logarithmic axis) is frequency, while a vertical axis is output from the microphone. Besides, in FIG. 12, a graph (a) shown by a solid line indicates a frequency characteristic in a case (i.e., a case where only the first sound guide space SP1 is used) where the sound wave enters from the first opening 102*a* only of the microphone unit 100. Besides, in FIG. 12, a graph (b) shown by a broken line indicates a frequency characteristic in a case (i.e., a case where only the second sound guide space SP2 is used) where the sound wave enters from the second opening 102*b* only of the microphone unit 100.

Here, when obtaining the data in FIG. 12, the sound source position is a constant position in the 180° direction in FIG. 11. When obtaining the data of each frequency characteristic, the sound pressures of the sounds released from the sound source are the same.

Of course, the microphone unit 100 is required to demonstrate the good distant noise alleviation performance at all the frequencies in its use frequency range (e.g., 100 Hz to 10 kHz). The distant noise alleviation performance is deeply involved in the above bi-directivity. And, to obtain the good distant noise alleviation performance in the use frequency range, the microphone unit 100 is required to demonstrate the bi-directivity shown in FIG. 11 at all the frequencies in the use frequency range.

In other words, in a case of inputting the sound wave into the microphone unit 100 from the sound source that is disposed in the 180° direction in FIG. 11, the graphs (a) and (b) in FIG. 12 are required to keep a constant output difference even if the frequency changes. Here, the constant output difference occurs because the distance from the sound source to the first opening 102*a* and the distance from the sound source to the second opening 102*b* are different from each other.

In the experimental result shown in FIG. 12, the graphs (a) and (b) keep the constant output difference until frequencies of about 100 Hz to 7 kHz. However, exceeding about 7 kHz, the above output difference does not become constant, and exceeding about 8 kHz, it is found out that the output values are reversed in size between the graph (a) and the graph (b). In other words, in the earlier developed microphone unit 100, the balance deteriorates in a high frequency band between the frequency characteristic when the sound wave travels in the first sound guide space SP1 and the frequency characteristic when the sound wave travels in the second sound guide space SP2, accordingly, an aimed bi-directivity is not obtained, which raises a problem that the good distant noise alleviation performance is not obtained.

For a purpose of easily achieving size reduction and thickness reduction of apparatuses (apparatuses such as a mobile phone and the like that have a sound input function) which incorporate the microphone unit 100, the microphone unit 100 has a structure which is provided with: the first opening 102*a* that guides the outside sound to the upper surface of the diaphragm 103*a*; and the second opening 102*b* that guides the outside sound to the lower surface of the diaphragm 103*a* that are formed through the same surface (the upper surface of the cover 102). However, to employ this structure, there is no choice but to form the first sound guide space SP1 and the second sound guide space SP2 into shapes different from each other in the microphone unit 100.

Besides, the MEMS chip 103 (the ASIC as well in a case where the ASIC is housed in the housing as a member separate from the MEMS chip) housed in the housing needs to be housed in either of the sound guide spaces SP1 and SP2, accordingly, it is hard to form the two sound guide spaces to have the same volume. Here, in the microphone unit 100, the MEMS chip 103 is housed in the first sound guide space SP1, and the first sound guide space SP1 is larger than the second sound guide space SP2 in volume.

It is conceived that caused by the above unbalance between the shapes of the first sound guide space SP1 and the second sound guide space SP2, the two sound guide spaces SP1 and SP2 have the frequency characteristics different from each other. And, it is conceived that caused by this, the problem occurs, in which good distant noise alleviation performance is unobtainable in a high frequency range.

By improving the structure of the earlier developed microphone unit 100, the present invention aims to match (approximate) the frequency characteristics of the above first sound guide spaces SP1 and the above second sound guide space SP2 with each other and to solve the above problems. Here, as the method for matching the frequency characteristics when the sound wave travels in the two sound guide spaces SP1 and SP2 with each other, there also is a conceivable method which uses an acoustic resistor member. However, the acoustic resistor member is usually composed of felt or like that, accordingly, there are concerns over invasion of dust into the MEMS chip 103 and the like. Because of this, to prevent the dust problem from occurring, the present invention matches the frequency characteristics when the sound wave travels in the two sound guide spaces SP1 and SP2 with each other by improving the structure of the microphone unit 100.

Microphone Unit According to the First Embodiment of the Present Invention

Figure 1A:
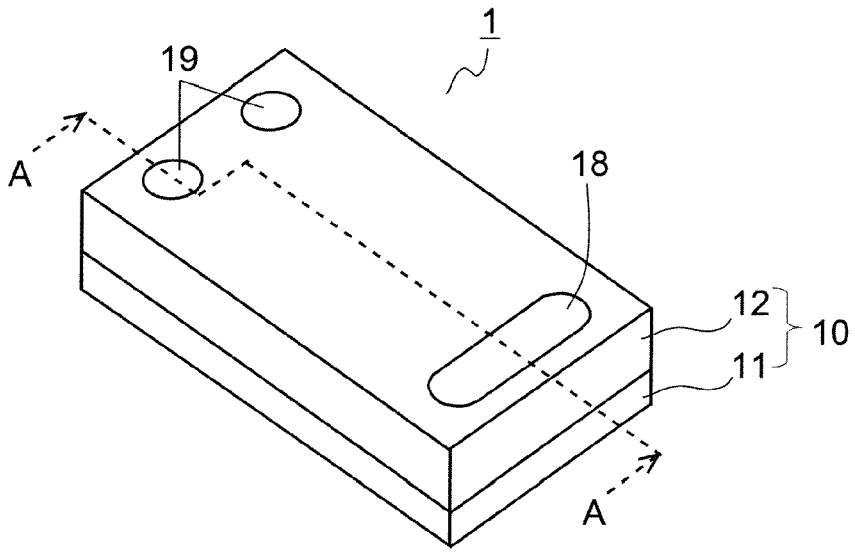
FIG. 1A is a schematic perspective view showing an appearance structure of a microphone unit according to a first embodiment.
Figure 1B:
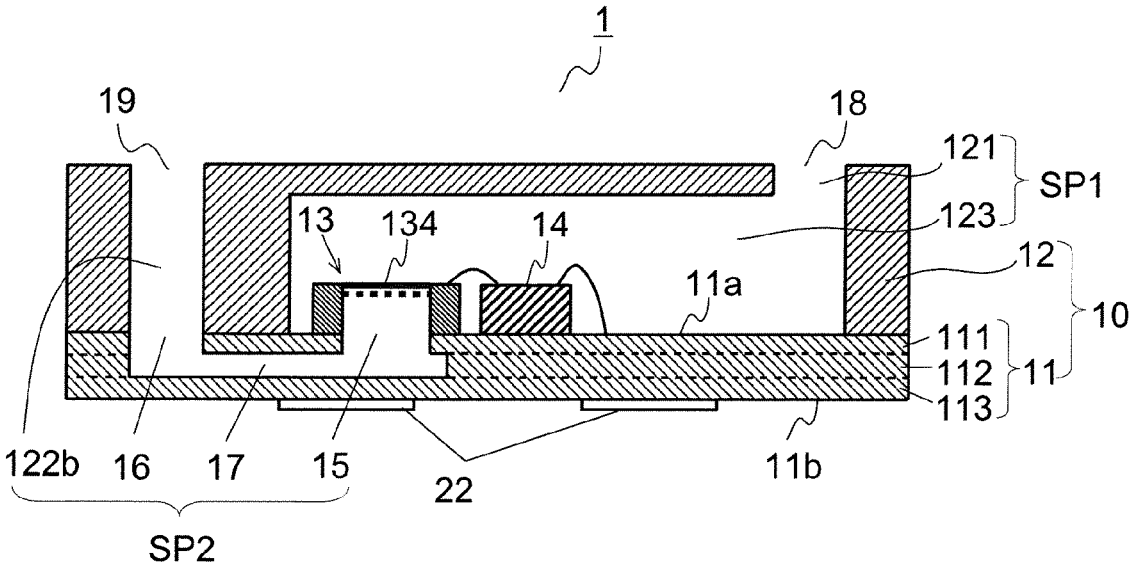
FIG. 1B is a sectional view taken along an A-A position of FIG. 1A.

FIG. 1A and FIG. 1B are views showing a structure of a microphone unit according to a first embodiment, of which FIG. 1A is a schematic perspective view showing an appearance structure, and FIG. 1B is a sectional view taken along an A-A position of FIG. 1A. As shown in FIGS. 1A and 1B, a microphone unit 1 according to the first embodiment includes: a mount portion 11 on which a MEMS chip 13 and an ASIC 14 are mounted; and a cover 12 that is disposed over the mount portion 11 to cover the MEMS chip 13 and the ASIC 14. The mount portion 11 and the cover 12 compose a housing 10 of the microphone unit 1, and the shape of the housing 10 is a substantially rectangular parallelepiped shape.

Here, in the present embodiment, the housing 10 has a length of 7 mm in a long-edge direction (which corresponds to a left-right direction of FIG. 1B), a length of 4 mm in a short-edge direction (which corresponds to a direction perpendicular to the paper surface of FIG. 1B), and a length of 1.5 mm in a thickness direction (which corresponds to a vertical direction of FIG. 1B). However, this size is a mere example, and of course, the size of the microphone unit according to the present invention is not limited to this. Besides, in the following description as well, sizes are disclosed, however, the sizes are mere examples.

Figure 2A:
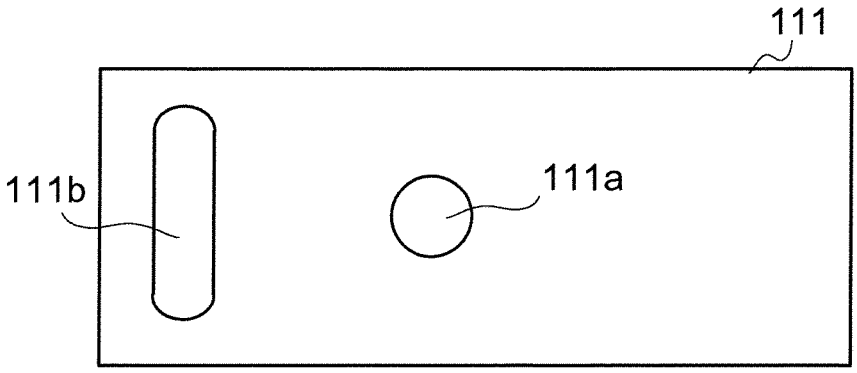
FIG. 2A is a top view of a first flat plate that composes a mount portion of the microphone unit according to the first embodiment.
Figure 2B:
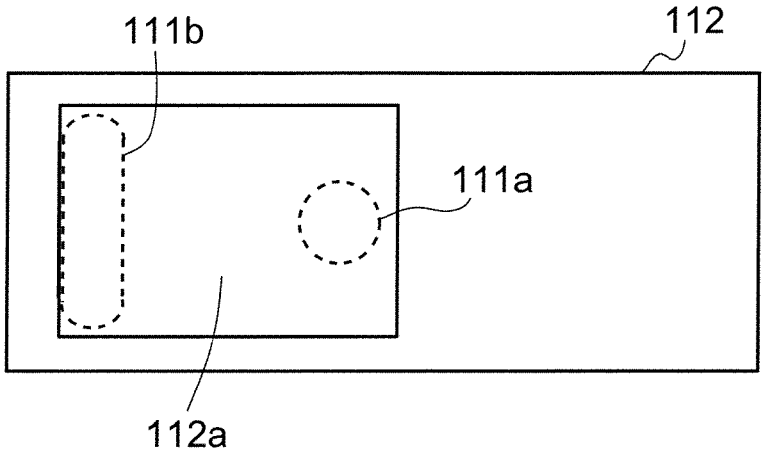
FIG. 2B is a top view of a second flat plate that composes the mount portion of the microphone unit according to the first embodiment.
Figure 2C:
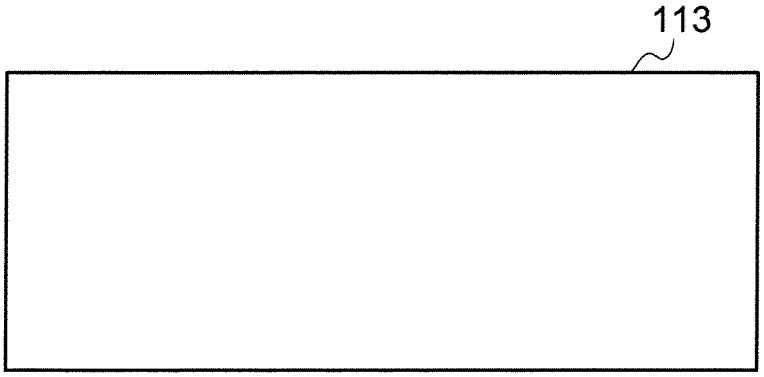
FIG. 2C is a top view of a third flat plate that composes the mount portion of the microphone unit according to the first embodiment.

The mount portion 11 is, as shown in FIG. 1B, composed of a third flat plate 113, a second flat plate 112, and a first flat plate 111 that are stacked up from bottom to top in this order. The flat plates are connected to one another by means of an adhesive, an adhesive sheet or the like. FIGS. 2A, 2B and 2C are schematic plan views showing the three flat plates that compose the mount portion of the microphone unit according to the first embodiment, of which FIG. 2A is a top view of the first flat plate, FIG. 2B is a top view of the second flat plate, and FIG. 2C is a top view of the third flat plate.

As shown in FIG. 2A, FIG. 2B and FIG. 2C, the three flat plates 111, 112 and 113 composing the mount portion 11 are all formed into a substantially rectangular shape when viewed from top, and the length, width when viewed from top and thickness have the substantially same size. Here, in the present embodiment, each flat plate has a length of 7 mm in the long-edge direction (horizontal direction), a length of 4 mm in the short-edge direction (vertical direction), and a thickness of 0.2 mm. Materials of the flat plates 111 to 113 that compose the mount portion 11 are not especially limited; however, publicly known materials used as a substrate material is preferably used, for example, FR-4, ceramics, polyimide film and the like are used.

The first flat plate 111 is, as shown in FIG. 2A, provided with a through-hole 111*a* that has a substantially circular shape when viewed from top and a thorough-hole 111*b* that has a substantially rectangular shape (substantially stadium shape) when viewed from top. In the present embodiment, the through-hole 111*a* having the a substantially circular shape when viewed from top has a diameter of 0.5 mm in section, while the through-hole 111*b* having the substantially rectangular shape when viewed from top has, in section, a length of 2 mm in the long-edge direction (vertical direction of FIG. 2A) and a length of 0.5 mm in the short-edge direction (left-right direction of FIG. 2A). The through-hole 111*b* having the substantially rectangular shape when viewed from top is disposed close to one end (close to a left end in FIG. 2A) in the long-edge direction of the first flat plate 111. Besides, the through-hole 111*a* having the substantially circular shape when viewed from top is disposed at a position slightly deviated from a center of the first flat plate 111 toward one side (where the through-hole 111*b* having the substantially rectangular shape when viewed from top is disposed) in the long-edge direction.

The second flat plate 112 is, as shown in FIG. 2B, provided with a through-hole 112*a* that has a substantially rectangular shape (whose upper surface and lower surface have the same shape and size as each other) when viewed from top. The through-hole 112*a* having the substantially rectangular shape when viewed form top is disposed such that the through-hole 111*a* and the through-hole 111*b* formed through the first flat plate 111 are confined in the region with the second flat plate 112 laid on the first flat plate 111. Here, in FIG. 2B, for the sake of easy understanding of a relationship between the first flat plate 111 and the second flat plate 112, the through-hole 111*a* and the through-hole 111*b* formed through the first flat plate 111 are shown by means of broken lines.

The third flat plate 113 is, as shown in FIG. 2C, a flat plate that is not provided with a through-hole. When the first flat plate 111, the second flat plate 112, and the third flat plate 113 having these structures are attached to one another, the mount portion 11, which is provided with a first mount portion opening 15 given by the through-hole 111*a*; a second mount portion opening 16 given by the through-hole 111*b*; and an intra-mount portion space 17 connecting the first mount portion opening 15 and the second mount portion opening 16 to each other, is obtained (see FIG. 1B).

Here, the mount portion 11 is provided with an electrode pad and an electric wiring, which are described later. Besides, in the present embodiment, the structure is employed, in which the mount portion 11 is obtained by attaching the three flat plates; however, the structure of the mount portion 11 is not limited to this structure, and may be composed of one flat plate or a plurality of flat plates the number of which is different from 3. Besides, the shape of the mount portion 11 is not limited to the plate shape. In a case where the mount portion 11 having a not-plate shape is composed of a plurality of members, a not-plate-shaped member may be included in the members that compose the mount portion 11. Further, the shapes of the first mount portion opening 15, the second mount portion opening 16 and the intra-mount portion space 17 are not limited to the structures of the present embodiment, and are suitably modifiable.

Figure 3A:
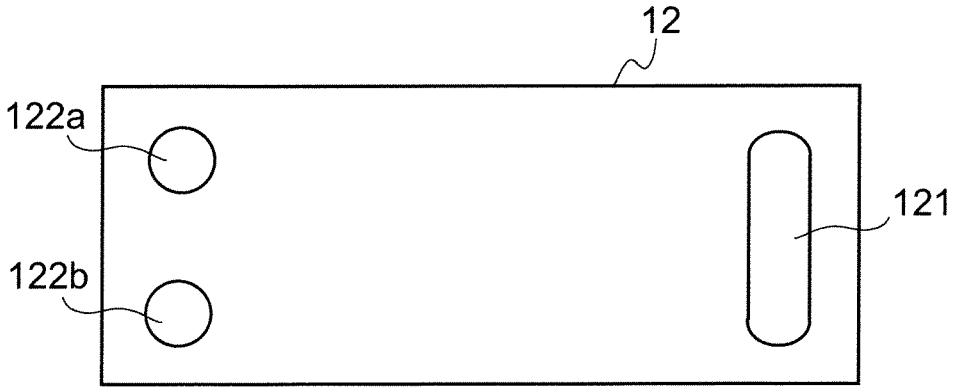
FIG. 3A is a schematic plan view showing a structure of a cover of the microphone unit according to the first embodiment, that is, a view when seeing the cover from top.
Figure 3B:
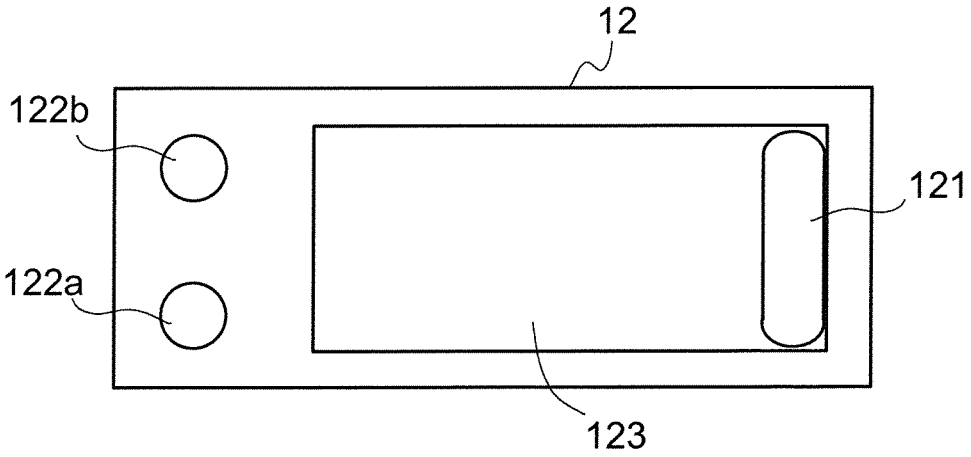
FIG. 3B is a schematic plan view showing a structure of the cover of the microphone unit according to the first embodiment, that is, a view when seeing the cover from bottom.

FIG. 3A and FIG. 3B are schematic plan views showing a structure of the cover of the microphone unit according to the first embodiment, of which FIG. 3A shows a state when seeing the cover from top, while FIG. 3B shows a state when seeing the cover from bottom. The cover 12 is formed, in its outer shape, into a substantially rectangular parallelepiped shape (also see FIG. 1A). Lengths of the cover 12 in a long-edge direction (left-right direction of FIG. 3A and FIG. 3B) and a short-edge direction (vertical direction of FIG. 3A and FIG. 3B) are the same as the lengths of the mount portion 11 in the long-edge direction and the short-edge direction, respectively. In detail, in the present embodiment, the length in the long-edge direction is 7 mm, and the length in the short-edge direction is 4 mm. Besides, the thickness of the cover 12 is 0.9 mm.

As shown in FIG. 3A and FIG. 3B, the cover 12 is provided, through one end side in the long-edge direction, with one through-hole 121 (example of a first through-hole of the present invention) having a substantially rectangular shape (substantially stadium shape) when viewed from top. This through-hole 121 has, in section, a length of 2 mm in its long-edge direction (vertical direction of FIG. 3A and FIG. 3B) and a length of 0.5 mm in its short-edge direction (left-right direction of FIG. 3A and FIG. 3B).

Besides, the cover 12 is provided with two through-holes 122*a* and 122*b* (example of a second through-hole of the present invention) having a substantially circular shape when viewed from top through the other end side (left side of FIG. 3A and FIG. 3B) in the long-edge direction. These through-holes 122*a* and 122*b* both have a diameter of 0.5 mm in section. The two through-holes 122*a* and 122*b* are ranged such that their centers stand in a line parallel to the short-edge direction (vertical direction of FIG. 3A and FIG. 3B) of the cover 12. Besides, the two through-holes 122*a* and 122*b* are adjusted positionally such that its one end (lower end) overlaps (connects to) the second mount portion opening 16 formed through the mount portion 11 with the cover 12 mounted on the mount portion 11.

Here, it is preferable that the through-hole 121 disposed through the one end side of the cover 12 and the through-holes 122*a*, 122*b* disposed through the other end side of the cover 12 are formed such that a distance in the long-edge direction (long-edge direction of the cover 12) (distance between a line parallel to the short-edge direction passing through the center of the through-hole 121 and a line parallel to the short-edge direction passing through the respective centers of the through-holes 122*a* and 122*b*) becomes 4 mm or longer to 6 mm or shorter. As described later, these through-holes 121, 122*a* and 122*b* are used as input portions for a sound wave. If the above distance is too wide, a phase difference between sound waves that reach an upper surface and a lower surface of a diaphragm 134 (disposed in the MEMS chip 13) becomes large, whereby a mike characteristic declines (noise alleviation performance declines). To alleviate such a trouble, it is preferable that the above distance is formed to be 6 mm or shorter. Besides, if the above distance is too narrow, a difference between sound pressures that act onto the upper surface and the lower surface of the diaphragm 134 becomes small and the amplitude of the diaphragm 134 becomes small, whereby the SNR (Signal to Noise Ratio) of an electric signal output from the ASIC 14 deteriorates. To alleviate such a trouble, it is preferable that the above distance is formed to be 4 mm or longer.

Besides, the cover 12 is provided with a recess portion 123 (whose depth is 0.7 mm in the present invention) that has a substantially rectangular shape when viewed from bottom. This recess portion 123 is disposed to overlap the through-hole 121 disposed through the one end side (right end side of FIG. 3B) in the long-edge direction of the cover 12, and the recess portion 123 and the through-hole 121 are in a state to connect to each other. On the other hand, the recess portion 123 is disposed not to overlap the two through-holes 122*a* and 122*b* disposed through the other end side (left end side of FIG. 3B) in the long-edge direction of the cover 12. In other words, the recess portion 123 does not connect to the two through-holes 122*a* and 122*b*.

As a material that composes the cover 12, it is possible to use, for example, resins such as LCP (Liquid Crystal Polymer), PPS (polyphenylene sulfide) and the like. Here, to give electrical conductivity to the resin, a metal filler such as stainless steel or the like or a carbon may be mixed with the resin that composes the cover 12. Besides, the material that composes the cover 12 may be a substrate material such as FR-4, ceramics or the like.

The MEMS chip 13 mounted on the mount portion 11 is an example of the electro-acoustic conversion device of the present invention that converts a sound signal into an electric signal based on vibration of the diaphragm. The MEMS chip 13 including a silicon chip is a small capacitor type microphone chip that is produced by means of a semiconductor production technology.

Figure 4:
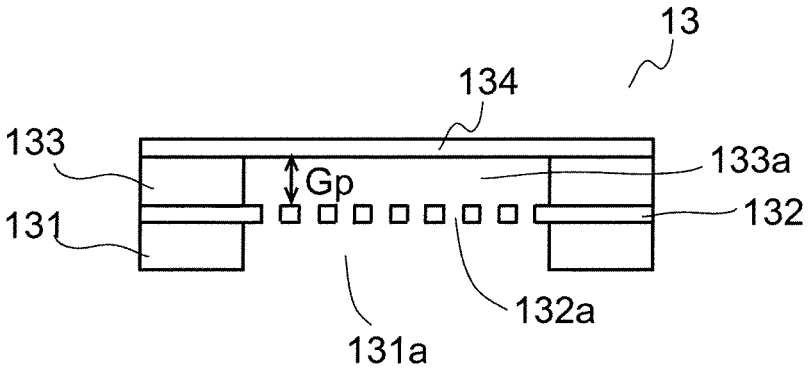
FIG. 4 is a schematic sectional view showing a structure of a MEMS chip of the microphone unit according to the first embodiment.

FIG. 4 is a schematic sectional view showing a structure of the MEMS chip of the microphone unit according to the first embodiment. As shown in FIG. 4, the MEMS chip 13 has a substantially rectangular parallelepiped shape in its outer shape, and includes: an insulating base substrate 131, a fixed electrode 132, an insulating intermediate substrate 133, and the diaphragm 134.

The base substrate 131 is provided, through its central portion, with a through-hole 131*a* that has a substantially circular shape when viewed from top. The fixed electrode 132 having a plate shape is disposed on the base substrate 131, and is provided with a plurality of small-diameter (about 10 μm in diameter) through-holes 132*a*. The intermediate substrate 133 is disposed on the fixed electrode 132, and is, like the base substrate 131, provided, through its central portion, with a through-hole 133*a* that has a substantially circular shape when viewed from top. The diaphragm 134 disposed on the intermediate substrate 133 is a thin film that receives a sound pressure to vibrate (vibrates in a vertical direction of FIG. 4. Besides, in the present embodiment, a substantially circular portion vibrates), has electro-conductivity and forms one end of an electrode. The fixed electrode 132 and the diaphragm 134, which are disposed to be in an opposing relationship to be substantially parallel to each other with a gap Gp thanks to the presence of the intermediate substrate 133, form a capacitor.

When a sound wave comes and the diaphragm 134 vibrates, the capacitor formed of the fixed electrode 132 and the diaphragm 134 changes in between—electrodes distance and, accordingly, changes in electrostatic capacity. As a result of this, it is possible to fetch the sound wave (sound signal), which enters the MEMS chip 13, as an electric signal. In the MEMS chip 13, the lower side of the diaphragm 134 also communicates with an outside (outside the MEMS chip 13) space thanks to the presence of the through-hole 131*a* formed through the base substrate 131, the plurality of through-holes 132*a* formed through the fixed electrode 132 and the through-hole 133*a* formed through the intermediate substrate 133.

Here, the structure of the MEMS chip 13 is not limited to the structure of the present embodiment, and the structure may be suitably modified. For example, in the present embodiment, the diaphragm 134 is over the fixed electrode 132; however, to obtain a reverse relationship (relationship in which the diaphragm is under and the fixed electrode is over), the MEMS chip 13 may be composed.

Figure 5:
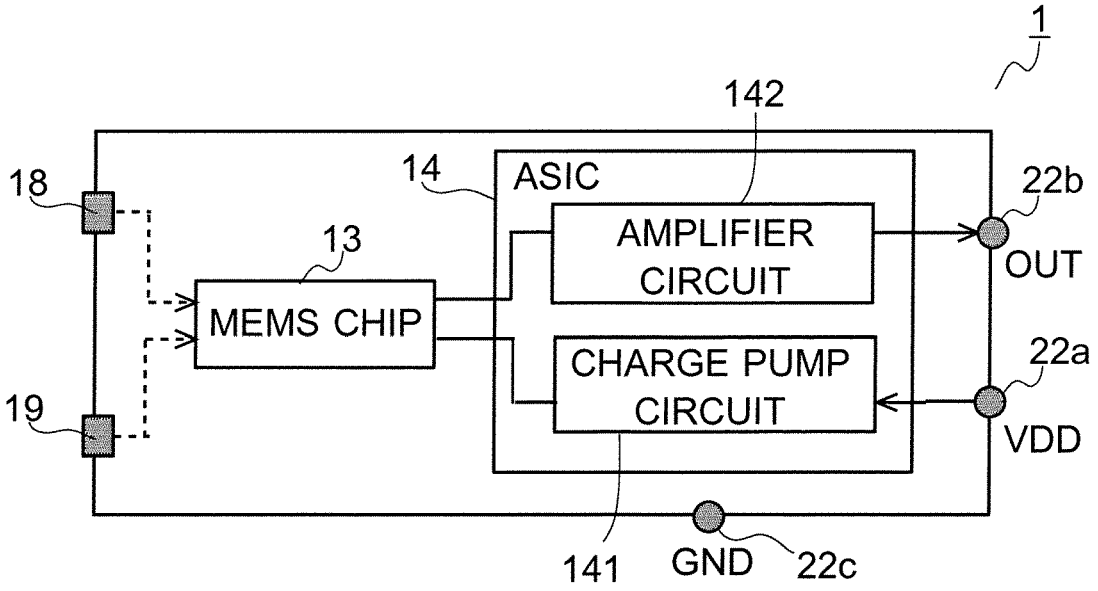
FIG. 5 is a block diagram showing a structure of the microphone unit according to the first embodiment.

The ASIC 14 is an integrated circuit that amplifies the electric signal that is fetched based on the change (caused by the vibration of the diaphragm 134) in the electrostatic capacity of the MEMS chip 13. Here, the ASIC 14 is an example of an electric circuit portion of the present invention. As shown in FIG. 5, the ASIC 14 includes a charge pump circuit 141 that applies a bias voltage to the MEMS chip 13. The charge pump circuit 141 steps up (e.g., about 6 to 10 V) a power supply voltage VDD (e.g., about 1.5 to 3 V) and applies the bias voltage to the MEMS chip 13. Besides, the ASIC 14 includes an amplifier circuit 142 that detects the change in the electrostatic capacity of the MEMS chip 13. The electric signal amplified by the amplifier circuit 142 is output from the ASIC 14. Here, FIG. 5 is a block diagram showing the structure of the microphone unit according to the first embodiment.

Figure 6:
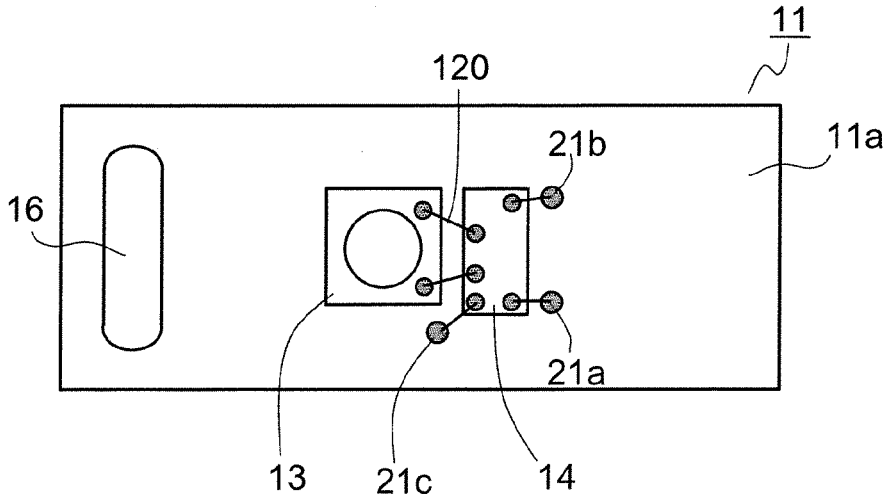
FIG. 6 is a schematic plan view when seeing, from top, the mount portion of the microphone unit according to the first embodiment, that is, a view showing a state in which a MEMS chip and an ASIC are mounted.

Here, with chief reference to FIG. 6, a positional relationship and electrical connection relationship between the MEMS chip 13 and the ASIC 14 of the microphone unit 1 are described. Here, FIG. 6 is a schematic plan view when seeing, from top, the mount portion of the microphone unit according to the first embodiment, that is, a view showing a state in which the MEMS chip and the ASIC are mounted.

The MEMS chip 13 is mounted on the mount portion 11 with the diaphragm 134 having an attitude (see FIG. 1B) substantially parallel to the upper surface (mount surface) 11*a* of the mount portion 11. And, the MEMS chip 13 is mounted on the mount portion 11 to cover the first mount portion opening 15 (see FIG. 1B) that is formed through the upper surface 11*a* of the mount portion 11. The ASIC 14 is disposed to be adjacent to the MEMS chip 13.

The MEMS chip 13 and the ASIC 14 are mounted on the mount portion 11 by means of die bonding and wire bonding. In detail, the MEMS chip 13 is bonded to the upper surface 11*a* of the mount portion 11 by means of a not-shown die bonding material (e.g., an epoxy resin adhesive, a silicone resin adhesive and the like) such that a gap is not formed between the bottom surface of the MEMS chip and the upper surface 11*a* of the mount surface 11. According to this bonding, a trouble, in which a sound leaks inside from a gap between the upper surface 11*a* of the mount portion 11 and the bottom surface of the MEMS chip 13, does not occur. Besides, as shown in FIG. 6, the MEMS chip 13 is electrically connected to the ASIC 14 by means of a wire 120 (preferably a gold line).

In the ASIC 14, a bottom surface, which opposes the upper surface 11*a* of the mount portion 11, is bonded to the upper surface 11*a* of the mount portion 11 by means of a not-shown die bonding material. As shown in FIG. 6, the ASIC 14 is electrically connected, by means of the wire 120, to each of a plurality of electrode terminals 21*a*, 21*b* and 21*c* that are formed on the upper surface 11*a* of the mount surface 11. The electrode terminal 21*a* is a power supply terminal for inputting the power supply voltage (VDD), the electrode terminal 21*b* is an output terminal that outputs the electric signal amplified by the amplifier circuit 142 of the ASIC 14, and the electrode terminal 21*c* is a GND terminal for ground connection The lower surface (rear surface of the mount surface 11*a*) 11*b* of the mount portion 11 is, as shown in FIG. 1B, provided with an external connection electrode pad 22. The external connection electrode pad 22 includes: a power supply electrode pad 22*a*; an output electrode pad 22*b*; and a GND electrode pad 22*c* (see FIG. 5). The power supply terminal 21*a* disposed on the upper surface 11*a* f the mount portion 11 is electrically connected to the power supply electrode pad 22*a* via a not-shown wiring (inclusive of a through-wiring) that is formed on the mount portion 11. The output terminal 21*b* disposed on the upper surface 11*a* f the mount portion 11 is electrically connected to the output electrode pad 22*b* via a not-shown wiring (inclusive of a through-wiring) that is formed on the mount portion 11. The GND terminal 21*c* disposed on the upper surface 11*a* f the mount portion 11 is electrically connected to the GND electrode pad 22*c* via a not-shown wiring (inclusive of a through-wiring) that is formed on the mount portion 11. It is possible to from the through-wiring by means of a through-hole via that is usually used in substrate production.

Besides, in the present embodiment, the structure is employed, in which the MEMS chip 13 and the ASIC 14 are mounted by means of wire bonding; however, of course, the MEMS chip 13 and the AISC 14 may be mounted by means of flip chip assembly. In this case, the electrode is formed on the lower surfaces of the MEMS chip 13 and the ASIC 14, the electrode pad corresponding to the electrode is disposed on the upper surface of the mount portion 11, and connection between them is performed by a wiring pattern formed on the mount portion 11.

The cover 12 is placed on the mount portion 11 on which the MEMS chip 13 and the ASIC 14 are mounted such that the recess portion 123 houses the MEMS chip 13 and the ASIC 14. And, when the mount portion 11 and the cover 12 are bonded (e.g., an adhesive or an adhesive sheet is used) to be air-tightly sealed, the microphone unit 1 which includes the MEMS chip 13 and the ASIC 14 in the housing 10 is obtained.

The housing 10 of the microphone unit 1 is, as shown in FIG. 1B, provided inside with the first sound guide space SP1 that is formed by means of the through-hole 121 provided through the cover 12 and the housing space (recess portion) 123 and guides a sound wave from outside to the upper surface of the diaphragm 134 via a first opening 18 (given by the through-hole 121). Besides, the housing 10 is provided inside with the second sound guide space SP2 that is formed by means of the two through-holes 122*a* and 122*b*, and the first mount portion opening 15, the second mount portion opening 16 and the intra-mount portion space 17 that are disposed in the mount portion 11, and guides a sound wave from outside to the lower surface of the diaphragm 134 via a second opening 19 (given by the two through-holes 122*a* and 122*b*). In other words, the microphone unit 1 is composed as a differential microphone unit.

Here, it is preferable that designing is performed such that the sound travel time span when the outside sound travels from the first opening 18 to the diaphragm 134 via the first sound guide space SP1 and the sound travel time span when the outside sound travels from the second opening 19 to the diaphragm 134 via the second sound guide space SP2 become equal to each other; and a sound travel distance when the outside sound travels from the first opening 18 to the diaphragm 134 via the first sound guide space SP1 and a sound travel distance when the outside sound travels from the second opening 19 to the diaphragm 134 via the second sound guide space SP2 become substantially equal to each other; the microphone unit 1 according to the present embodiment is composed in such a way.

The microphone unit 1 having the above structure shows an excellent distant noise alleviation performance like the above earlier developed microphone unit 100. And, the earlier developed microphone unit 100 has the problem that the distant noise alleviation performance deteriorates in a high frequency band; however, in the microphone unit 1 according to the present embodiment, the problem is solved. Hereinafter, this is described.

In the microphone unit 1 according to the present embodiment, the first sound guide space SP1 and the second sound guide space SP2 are different from each other in shape and volume. This point is the same as the earlier developed microphone unit 100. However, in the microphone unit 1, the relationship between the first opening 18 that connects the first sound guide space SP1 and the outside to each other and the second opening 19 that connects the second sound guide space SP2 and the outside to each other is different from the structure of the earlier developed microphone unit 100. And, because of this difference, the microphone unit 1 demonstrates the good distant noise alleviation performance in the high frequency band as well.

Here, in the present embodiment, the volume of the first sound guide space SP1 is about 5 $mm^3$, while the volume of the second sound guide space SP2 is 2 $mm^3$.

As described above, it was conceived that the reason the good distant noise alleviation performance is not obtained in the earlier developed microphone unit 100 is the frequency characteristic when the sound wave travels in the first sound guide space SP1 is different from the frequency characteristic when the sound wave travels in the second sound guide space SP2. In other words, it was conceived that the good distant noise alleviation performance is obtained in the high frequency band by matching the frequency characteristics when the sound wave travels in the two sound guide spaces SP1 and SP2 with each other.

Accordingly, the inventors of the present application came up with an idea of improving the structure of the conventional microphone unit 100, approximating the resonance frequencies of the two sound guide spaces SP1 and SP2 to each other by means of the improvement, and thereby matching the frequency characteristic when the sound wave travels in the first sound guide space SP1 and the frequency characteristic when the sound wave travels in the second sound guide space SP2 with each other. Here, matching the frequency characteristics when the sound wave travels in the two sound guide spaces SP1 and SP2 with each other by improving the conventional structure is intended to provide the microphone unit that does not cause the trouble that the MEMS chip malfunctions because of the above influence of dust (which occurs from the acoustic resistor member).

It is conceived that the first sound guide space SP1 behaves in the same way as a well-known Helmholtz resonator because of its shape. Because of this, it is conceived that the resonance frequency fr of the first sound guide space SP1 is given by the following formula (2). Here, in the formula (2), Cv is a sound velocity, S is an area (sectional area of the through-hole 121) of the first opening 18, Lp is a thickness (hole length) of the through-hole 121 that is disposed through the cover 12, ΔL is an opening end correction, and V is a volume of the housing space 123.

$$fr = \frac{Cv}{2\pi}\sqrt{\frac{S}{(Lp + \Delta L)\cdot V}} \tag{2}$$

As is understood from the formula (2), the resonance frequency of the first sound guide space SP1 changes by changing at least one of the volume of the housing space 123, the area of the first opening 18, and the thickness of the through-hole 121. On the other hand, it is conceived that the second sound guide space SP2 is completely different from the Helmholtz resonator in shape, accordingly, it is conceived that it is impossible to simply express the resonance frequency by means of the formula (2). However, it is conceived that it is possible to change the resonance frequency by means of the same parameter in the second sound guide space SP2 as well.

As a result of a deep study considering the above formula (2), the request for size reduction and easy production of the microphone unit, when improving the conventional microphone unit 100, it is found good to perform the following improvement. In other words, it is found out that it is possible to approximate the frequency characteristics (resonance frequencies) when the sound wave travels in the two sound guide spaces SP1 and SP2 to each other by making the total area of the opening, which is disposed through the housing 10 to guide the outside sound to the upper lower surface of the diaphragm 134, and the total area of the opening, which is disposed through the housing 10 to guide the outside sound to the lower surface of the diaphragm 134, different from each other.

In the microphone unit 1 according to the present embodiment, there is a tendency that the first sound guide space SP1 on the side where the MEMS chip 13 having the diaphragm 134 is disposed becomes larger than the second sound guide space SP2 in volume and becomes lower than the second sound guide space SP2 in resonance frequency. In this case, to match the resonance frequencies of the two sound guide spaces SP1 and SP2 with each other, it is conceived to employ a structure in which the resonance frequency of the second sound guide space SP2 becomes small or to employ a structure in which the resonance frequency of the first sound guide space SP1 becomes high. In the microphone unit 1, the former structure is employed.

Specifically, the total area of the first opening 18 is formed to be the same as the structure of the earlier developed microphone unit 100, while the total area of the second opening 19 is formed to be smaller than the case (i.e., the total area of the first opening 18) of the earlier developed microphone unit 100. It is decided based on experiments and the like how small the total area should be formed.

Here, in the microphone unit 1, there is only one first opening 18, accordingly, the total area of the first opening 18 is the area (equal to the sectional area of the through-hole 121) of the first opening 18 itself. Besides, there are two second openings 19, accordingly, the total area of the second opening 19 is a summed area of the areas (each is equal to the sectional area of each of the through-holes 122*a* and 122*b*) of the two second openings 19.

When making the total area of the second opening 19 smaller than the total area of the first opening 18, the second opening 19 may be formed to have a shape similar (which does not invariably mean to be limited to the similar shape) to the first opening 18 (substantially rectangular shape and stadium shape) and may be formed by one that is smaller than the first opening 18 in area. Regarding this point, in the present embodiment, considering workability and the like during the production time, the two second openings 19, which are small openings (whose diameter is the same as the length of the first opening in the short-edge direction) each having the substantially circular shape (this shape may be suitably modified) when viewed from top, are disposed, whereby size reduction of the total area of the second opening 19 is achieved.

Here, the number of the second openings 19 may be two or more; however, if there are too many, there is a case where a problem occurs to deteriorate the workability during the production time and the like, accordingly, it is preferable not to form too many second openings.

Figure 7:
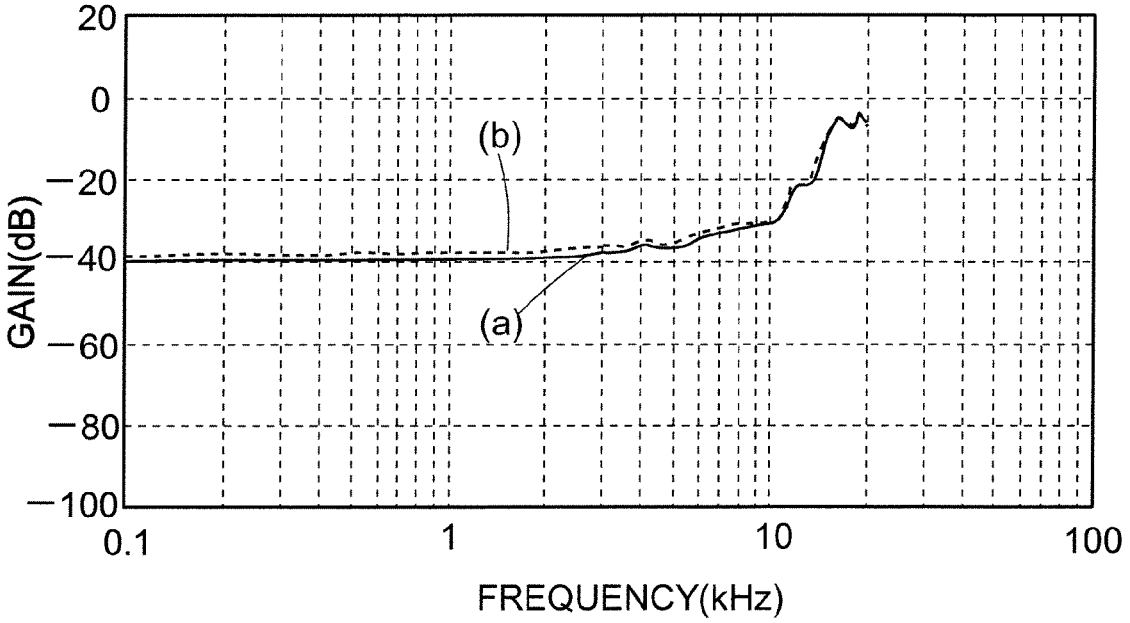
FIG. 7 is a graph showing a frequency characteristic in a case where either one only of a first sound guide space and a second sound guide space is used in the microphone unit according to the first embodiment.

FIG. 7 is a graph showing a frequency characteristic in a case where either one only of the first sound guide space and the second sound guide space is used in the microphone unit 1 according to the first embodiment. FIG. 7 is a graph similar to FIG. 12 described above, and the frequency characteristic is obtained by a method similar to FIG. 12. In FIG. 7, a graph (a) shown by a solid line indicates a frequency characteristic in a case where only the first sound guide space SP1 of the microphone unit 1 is used, while a graph (b) shown by a broken line indicates a frequency characteristic in a case where only the second sound guide space SP2 of the microphone unit 1 is used.

As shown in FIG. 7, in the microphone unit 1 according to the present embodiment, outputs in the graph (a) and the graph (b) are not reversed in a high frequency band (7 kHz or higher), and it is possible to obtain a bi-directivity near to an aimed one in the high frequency band. In other words, the microphone unit 1 indicates the good distant noise alleviation performance even in the high frequency band (wide frequency band).

Microphone Unit According to the Second Embodiment of the Present Invention

A microphone unit according to a second embodiment has the same structure as the microphone unit 1 according to the first embodiment except for the structure of the cover that is mounted on the mount portion 11 to cover the MEMS chip 13. Hereinafter, only different points are described. Here, portions common to the first embodiment are indicated by the same reference numbers and described.

Figure 8A:
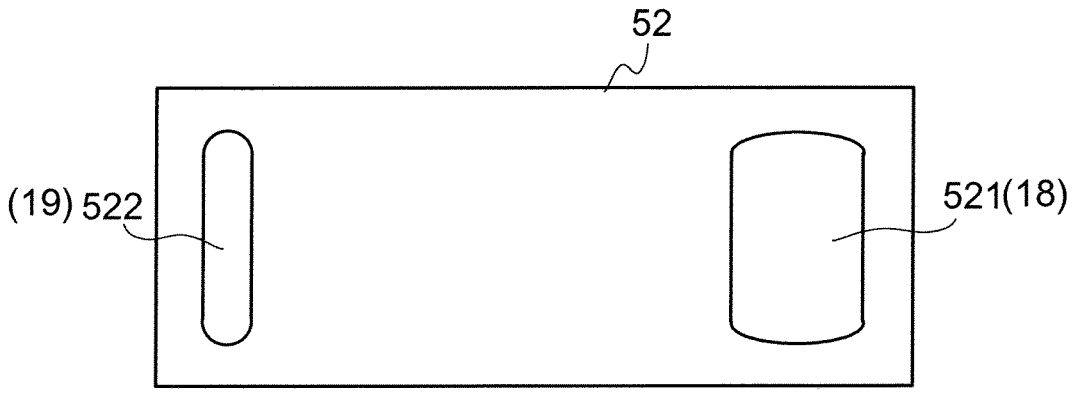
FIG. 8A is a schematic plan view showing a structure of a cover of a microphone unit according to a second embodiment, that is, a view when seeing the cover from top.
Figure 8B:
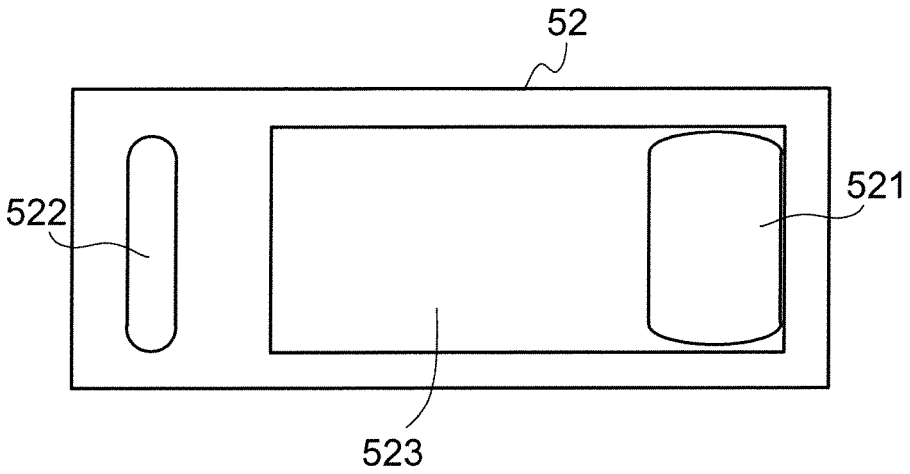
FIG. 8B is a schematic plan view showing a structure of the cover of the microphone unit according to the second embodiment, that is, a view when seeing the cover from bottom.

FIG. 8A and FIG. 8B are schematic plan views showing a structure of a cover of the microphone unit according to the second embodiment, of which FIG. 8A shows a state when seeing the cover from top, while FIG. 8B shows a state when seeing the cover from bottom. A cover 52 of the microphone unit according to the second embodiment is formed, in its outer shape, into a substantially rectangular parallelepiped shape, and lengths of the cover in a long-edge direction (left-right direction of FIG. 8A and FIG. 8B) and a short-edge direction (vertical direction of FIG. 8A and Fig. B) are the same as the lengths of the mount portion 11 in the long-edge direction and the short-edge direction, respectively. In detail, in the present embodiment, the length in the long-edge direction is 7 mm, and the length in the short-edge direction is 4 mm. Besides, the thickness of the cover 52 is 0.9 mm. Here, the material of the cover 52 may be the same as the first embodiment.

As shown in FIG. 8A and FIG. 8B, the cover 52 is provided, through one end side in its long-edge direction, with one through-hole 521 (example of the first through-hole of the present invention) having a substantially rectangular shape (substantially stadium shape) when viewed from top. This through-hole 521 has, in section, a length of 2 mm in its long-edge direction (vertical direction of FIG. 8A and FIG. 8B) and a length of 1.5 mm in its short-edge direction (left-right direction of FIG. 8A and FIG. 8B).

Besides, the cover 52 is provided, through the other end side (left side of FIG. 8A and FIG. 8B) in its long-edge direction, with one through-hole 522 (example of the second through-hole of the present invention) having a substantially rectangular shape (substantially stadium shape) when viewed from top. This through-hole 522 has, in section, a length of 2 mm in its long-edge direction (vertical direction of FIG. 8A and FIG. 8B) and a length of 0.5 mm in its short-edge direction (left-right direction of FIG. 8A and FIG. 8B). Besides, the through-hole 522 is adjusted positionally such that its one end (lower end) overlaps the second mount portion opening 16 (see FIG. 1B) formed through the mount portion 11 with the cover 52 mounted on the mount portion 11.

Here, for the same reason in the case of the microphone unit 1 according to the first embodiment, it is preferable that the through-hole 521 disposed through the one end side of the cover 52 and the through-hole 522 disposed through the other end side of the cover 52 are formed such that a distance (distance between the centers of the two through-holes 521 and 522) in the long-edge direction (long-edge direction of the cover 52) becomes 4 mm or longer to 6 mm or shorter.

The cover 12 is provided with a recess portion 523 (whose depth is 0.7 mm in the present invention) that has a substantially rectangular shape when viewed from bottom. This recess portion 523 is disposed to overlap the through-hole 521 disposed through the one end side (right end side of FIG. 8B) of the cover 52 in the long-edge direction, and the recess portion 523 and the through-hole 521 are in a state to connect to each other. On the other hand, the recess portion 523 is formed not to overlap the through-hole 522 disposed through the other end side of the cover 52 in the long-edge direction. In other words, the recess portion 523 does not connect to the through-hole 522.

Thanks to the through-hole 521 disposed through the cover 52, the first opening 18 is obtained, which connects the first sound guide space SP1 of the microphone unit according to the second embodiment and the outside to each other. Besides, thanks to the through-hole 522 disposed through the cover 52, the second opening 19 is obtained, which connects the second sound guide space SP2 of the microphone unit according to the second embodiment and the outside to each other. The total area of the first opening 18 is larger than the total area of the second opening 19.

Here, in the microphone unit according to the second embodiment, there is only one first opening 18, accordingly, the total area of the first opening 18 is the area (equal to the sectional area of the through-hole 521) of the first opening 18 itself. Besides, also there is only one second opening 19, accordingly, the total area of the second opening 19 is the area (equal to the sectional area of the through-hole 522) of the second opening 19 itself.

Also in the microphone unit according to the second embodiment, there is a tendency that the first sound guide space SP1 on the side where the MEMS chip 13 having the diaphragm 134 is disposed becomes larger than the second sound guide space SP2 in volume and becomes lower than the second sound guide space SP2 in resonance frequency. In this case, to match the resonance frequencies of the two sound guide spaces SP1 and SP2 with each other, it is conceived to employ a structure in which the resonance frequency of the second sound guide space SP2 becomes small or to employ a structure in which the resonance frequency of the first sound guide space SP1 becomes high. In the second embodiment, in contrast to the case of the first embodiment, the latter structure is employed.

Specifically, the total area of the second opening 19 is formed to be the same as the structure of the earlier developed microphone unit 100, while the total area of the first opening 18 is formed to be larger than the case (i.e., the total area of the second opening 19) of the earlier developed microphone unit 100. According to this structure, the microphone unit according to the second embodiment indicates the good distant noise alleviation performance even in the high frequency band (wide frequency band).

(Others)

The microphone units described in the above embodiments are examples of the present invention, and the application scope of the present invention is not limited to the above embodiments. In other words, various modifications may be added to the above embodiments without departing from the object of the present invention.

For example, the shapes of the first opening 18 and the second opening 19 are not limited to the shapes of the above embodiments, and are suitably modifiable. Here, if the area of the opening (which guides the sound wave into the housing) disposed through the housing 10 of the microphone unit 1 is formed too small, the resonance frequencies of the first sound guide space SP1 and the second sound guide space SP2 become too low, which is not preferable. It is preferable that the output from the microphone unit becomes flat in a use frequency range (e.g., 100 Hz to 10 kHz); however, if the resonance frequency becomes too low, the above flatness is unobtainable. In this meaning, it is necessary to secure certain-size areas (total areas) of the openings 18 and 19 disposed through the housing 10 of the microphone unit 1. If the opening (which guides the sound wave into the housing) disposed through the housing is formed into an oblong shape (substantially rectangular shape and substantially stadium shape) in the short-edge direction of the microphone unit, it is possible to keep the size of the microphone unit 1 in the long-edge direction and secure a large area. Considering these points, in the microphone units according the first embodiment and the second embodiment, the oblong shape (substantially rectangular shape and substantially stadium shape) are employed for the first opening 18 and the second opening 19.

The number of the first openings 18 and the number of the second openings 19 are not limited to the above structure, and may be suitably modified on condition that the total area of the first opening 18 becomes larger than the total area of the second opening 19.

Besides, in the above embodiments, the MEMS chip 13 and the ASIC 14 are composed of chips separate from each other; however, the integrated circuit mounted on the ASIC 14 may be monolithically formed on the silicon substrate that forms the MEMS chip 13. In other words, the MEMS chip 13 and the ASIC 14 may be formed integrally with each other. Besides, in the above embodiments, the structure is employed, in which the ASIC 14 is housed in the housing 10; however, the AISC 14 may be disposed outside the hosing 10.

Besides, in the above embodiments, the structure is employed, in which the electro-acoustic conversion device for converting the sound pressure into the electric signal is the MEMS chip 13 that is formed by means of the semiconductor technology; however, this structure is not limiting. For example, the electro-acoustic conversion device may be a capacitor microphone unit and the like that use an electret film.

Besides, in the above embodiments, as the structure of the electro-acoustic conversion device of the microphone unit, the so-called capacitor type microphone is employed. However, the present invention is applicable to a microphone unit that employs a structure other than the capacitor type microphone. For example, the present invention is applicable to a microphone unit which employs a moving conductor (dynamic) type microphone, an electromagnetic (magnetic) type microphone, a piezo-electric type microphone and the like.

INDUSTRIAL APPLICABILITY

The microphone unit according to the present invention is suitable to, for example, voice communication apparatuses such as a mobile phone, a transceiver and the like, voice processing systems (voice identification system, voice recognition system, command generation system, electronic dictionary, translation apparatus, remote controller of voice input type and the like) that use a technology for analyzing an input voice, or to recording apparatuses and amplifier systems (loud speakers), mike systems and the like.

REFERENCE SIGNS LIST

1 microphone unit
10 housing
11 mount portion
12, 52 covers
13 MEMS chip (electro-acoustic conversion device)
14 ASCI (electric circuit portion)
15 first mount portion opening
16 second mount portion opening
17 intra-mount portion space
18 first opening
19 second opening
121, 521 through-holes (first through-holes)
122*a*, 122*b*, 522 through-holes (second through-holes)
123 recess portion•housing space
134 diaphragm
SP1 first sound guide space
SP2 second sound guide space

The invention claimed is:

1. A microphone unit comprising: an electro-acoustic conversion device that converts an input sound into an electric signal; and a housing that houses the electro-acoustic conversion device; wherein:

an outer surface of the housing is provided with at least one first opening and at least one second opening, the housing is provided therein with: a first sound guide space that guides a sound from outside the housing to a first surface of the electro-acoustic conversion device via the at least one first opening; and a second sound guide space that guides a sound from outside the housing to a second surface of the electro-acoustic conversion device via the at least one second opening;

the first sound guide space and the second sound guide space are each one space;

the first sound guide space has a large volume compared with the second sound guide space; and a total area of the at least one first opening is larger than a total area of the at least one second opening.

2. The microphone unit according to claim 1, wherein:

the second sound guide space has a shape different from that of the first sound guide space; and the at least one first opening and the at least one second opening are formed through the same flat surface of the housing.

3. The microphone unit according to claim 1, wherein the at least one first opening comprises one first opening and the at least one second opening comprises a plurality of second openings.

4. The microphone unit according to claim 1, wherein the at least one first opening comprises one first opening and the at least one second opening comprises one second opening.

5. The microphone unit according to claim 1, wherein:

the housing includes: a mount portion on which the electro-acoustic conversion device is mounted; and a cover that is disposed over the mount portion to cover the electro-acoustic conversion device;

the mount portion is provided with: a first mount portion opening that is covered by the electro-acoustic conversion device; a second mount portion opening that is formed through a same surface as the first mount portion opening; and an intra-mount portion space that connects the first mount portion opening and the second mount portion opening to each other;

the cover is provided with: a housing space that houses the electro-acoustic conversion device; at least one first through-hole whose one end connects to the housing space and whose other end connects to outside the cover; and at least one second through-hole which does not connect to the housing space, whose one end connects to the second mount portion opening, and whose other end connects to outside the cover;

the first opening is given by the first through-hole, and the second opening is given by the second through-hole;

the first sound guide space is formed by means of the first through-hole and the housing space; and the second sound guide space is formed by means of the second through-hole, the first mount portion opening, the second mount portion opening, and the intra-mount portion space.

6. The microphone unit according to claim 1, wherein an electric circuit portion, which processes the electric signal obtained from the electro-acoustic conversion device, is disposed in the first sound guide space.

7. The microphone unit according to claim 3, wherein the at least one second opening comprises two openings.

8. The microphone unit according to claim 3, wherein the plurality of second openings have the same shape as one another.

9. The microphone unit according to claim 1, wherein:

the first sound guide space has a shape in which a resonance frequency fulfills the formula $fr=Cv/2\pi\cdot\sqrt{(S/(Lp+\Delta L)\cdot V)}$, and the second sound guide space has a shape in which a resonance frequency does not fulfill the formula $fr=Cv/2\pi\cdot\sqrt{(S/(Lp+\Delta L)\cdot V)}$, where:

fr is a resonance frequency of a sound path;

Cv is a sound velocity;

S is an area of an opening;

V is a volume of a space;

Lp is a length of a slender pipe connected to the space; and $\Delta L$ is an opening end correction.

10. The microphone unit according to claim 1, wherein a total area of the at least one first opening is two times as large as or larger than a total area of the at least one second opening.

11. The microphone unit according to claim 1, wherein:

the electro-acoustic conversion device includes a diaphragm;

the first sound guide space is a continuous space that contacts a first surface of the diaphragm; and the second sound guide space is a continuous space that contacts a second surface of the diaphragm.

12. The microphone unit according to claim 1, wherein:

the first opening is substantially rectangular in a planar view, and the second opening is substantially circular in a planar view.

13. The microphone unit according to claim 1, wherein the first opening and the second opening are substantially rectangular in a planar view.

14. The microphone unit according to claim 1, wherein:

a plurality of the second openings are provided, and sound travel distances when the sound travels from the plurality of second openings to the second surface are substantially equal to each other.

15. The microphone unit according to claim 1, wherein a sound travel distance when the sound travels from the first opening to the first surface and a sound travel distance when the sound travels from the second opening to the second surface are substantially equal to each other.

* * * * *